US009216437B2

(12) United States Patent
Heitfeld

(10) Patent No.: US 9,216,437 B2
(45) Date of Patent: Dec. 22, 2015

(54) SYSTEM AND METHOD FOR GYRATORY SIFTER DEBLINDING

(75) Inventor: Mark Heitfeld, Cleves, OH (US)

(73) Assignee: M-I, LLC, Houston, TX (US)

( * ) Notice: Subject to any disclaimer, the term of this patent is extended or adjusted under 35 U.S.C. 154(b) by 134 days.

(21) Appl. No.: 13/122,639

(22) PCT Filed: Oct. 14, 2009

(86) PCT No.: PCT/US2009/060584
§ 371 (c)(1),
(2), (4) Date: Apr. 5, 2011

(87) PCT Pub. No.: WO2010/045284
PCT Pub. Date: Apr. 22, 2010

(65) Prior Publication Data

US 2011/0186484 A1 Aug. 4, 2011

Related U.S. Application Data

(60) Provisional application No. 61/106,373, filed on Oct. 17, 2008.

(51) Int. Cl.
*B07B 1/28* (2006.01)
*B07B 1/38* (2006.01)
*B07B 1/54* (2006.01)

(52) U.S. Cl.
CPC ... *B07B 1/38* (2013.01); *B07B 1/54* (2013.01); *B07B 2201/04* (2013.01)

(58) Field of Classification Search
USPC ..... 209/323, 326, 381, 382, 330, 347, 379
See application file for complete search history.

(56) References Cited

U.S. PATENT DOCUMENTS

| | | | | | |
|---|---|---|---|---|---|
| 2,031,240 | A | | 2/1936 | Van Deest | |
| 2,078,382 | A | | 4/1937 | Hanshaw | |
| 2,332,780 | A | | 10/1943 | Cecka | |
| 2,829,772 | A | * | 4/1958 | Landes et al. | 209/323 |
| 2,858,023 | A | * | 10/1958 | Holland | 209/381 |
| 3,366,239 | A | * | 1/1968 | Swallow | 209/332 |
| 3,565,251 | A | * | 2/1971 | Pennington | 209/323 |
| 4,498,981 | A | * | 2/1985 | Frevert | 209/243 |
| 4,929,346 | A | * | 5/1990 | Si-Lin | 209/323 |
| 5,165,550 | A | * | 11/1992 | Pierson et al. | 209/323 |
| 6,095,339 | A | * | 8/2000 | Filip | 209/382 |
| 2008/0245707 | A1 | | 10/2008 | Smith | |

OTHER PUBLICATIONS

International Search Report and Written Opinion, mailed Mar. 3, 2010, for PCT/US2009/060584.

* cited by examiner

*Primary Examiner* — Joseph C Rodriguez
*Assistant Examiner* — Kalyanavenkateshware Kumar
(74) *Attorney, Agent, or Firm* — Patents+TMS, P.C.

(57) ABSTRACT

Enhanced action cleaning elements enable increased deblinding efficiency of gyratory sifters. The enhanced action cleaning elements increase the collisions between the elements and the screens of the gyratory sifters to enhance deblinding the screens of the gyratory sifter.

9 Claims, 4 Drawing Sheets

Dodecahedron
(Regular polyhedron)

Small stellated dodecahedron
(Regular star)

Icosidodecahedron
(Uniform)

Great cubicuboctahedron
(Uniform star)

Rhombic triacontahedron
(Uniform dual)

Elongated pentagonal cupola
(Convex regular-faced)

Octagonal prism

Square antiprism

SYSTEM AND METHOD FOR GYRATORY SIFTER DEBLINDING

BACKGROUND

1. Field of the Invention

The invention relates generally to the field of solids separation through the use of a gyratory sifter. More specifically, the invention relates to methods and systems for cleaning ("deblinding") gyratory sifter screens.

2. Description of the Related Art

Gyratory sifters are used in a variety of applications for separating solids by size. These applications include separating particles of sugar, flour, sand and various chemical powders. Typical gyratory sifters include screens or perforated plates oriented generally horizontally, sloping from the head to the tail end of the sifter. FIG. 1 depicts a cross-section of one example of a gyratory sifter, shown generally at (1). Screens (10) are depicted in FIG. 1. Screens (10) are designed to allow particles with generally smaller diameters than the openings in the screen to pass through the screen, while larger particles remain above screens (10). Gyratory sifter (1) often uses an eccentric drive mechanism or other motive force (not shown) to provide a circular motion substantially in a horizontal plane, as shown in FIG. 2. Circular lines (100) depict the circular motion imparted on the particles on screens (10).

One problem often associated with the use of gyratory sifters is the tendency of the particles-to-be sifted to agglomerate or otherwise stick together. Further, these agglomerated particles-to-be sifted may plug the openings in the screens, preventing smaller size particles from properly passing through the screens. In addition, particles approximately the same size as the openings may plug the openings rather than pass through them, due to eccentricities in particle diameter.

Various means are known in the art to remedy the foregoing problems, including the use of roller brushes underneath the screens having bristles that project through the screen, and air jet cleaning which forces air through jets below the screen to dislodge particles that may be plugging holes in the screens. These cleaning methods may be undesirable, as they often require that the sifter operation be halted during the cleaning process and involve complicated additional machinery beyond what would normally be required for the sifter. Another method is the use of cleaning elements, typically spheres, to clean the screens during operation of the sifter. As depicted in FIGS. 1, 3 and 4, in using spheres for cleaning gyratory sifters, ballboxes (20) are located beneath screens (10) in gyratory sifter (1). Ballboxes (20) include ballbox screens (22). Ballbox screens (22) typically have significantly larger openings than the screens (10) and are configured to allow particles that pass through the screens (10) to freely pass through the holes in ballbox screen (22). Ballbox screens (22) are bounded by sides (24). Slats (26) are often included as part of ballbox (20) to provide support for ballbox screens (22). Ballbox (20) is configured to contain a plurality of deblinding spheres and to maintain those spheres between it and screen (10). In the sphere cleaning method, the spheres are configured to bounce between ballbox screens (22) and screens (10), dislodging any agglomerated or near-hole-sized particles that may have plugged the openings in the screens (10). The sphere method, compared to the roller brushes and air jet cleaning, is typically simpler and easier to maintain, and is typically used while the gyratory sifter is operating to separate particles. However, because the motion of the gyratory sifter is mostly in a nominally horizontal plane, i.e., a plane along the face of screens (10), little force in the nominally vertical plane, i.e., normal to the face of screens (10) may be imparted to the round spheres, limiting their effectiveness in dislodging the agglomerated or near-hole-sized particles on screens (10).

Accordingly, there exists a need for a cleaning method for a gyratory sifter that may provide more effective cleaning than methods known in the art.

SUMMARY

A gyratory sifter system in one aspect of the invention includes a gyratory sifter, having a screen and a ballbox. The ballbox is disposed below the screen. The gyratory sifter system further includes a plurality of enhanced action cleaning elements that are configured to collide with each other and the ballbox and are further configured to impart vertical momentum to each other as a result of those collisions. The vertical momentum imparted is substantially greater than the vertical momentum that would be imparted by collisions between spheres.

A gyratory sifter system in another aspect of the invention includes gyratory sifter having a screen and a ballbox, with the ballbox disposed below the screen. The gyratory sifter system further includes an enhanced action cleaning means for dislodging particles from the screens. The enhanced action cleaning means are configured to collide with each other and the ballbox and are further configured to impart vertical momentum to each other as a result of those collisions wherein the vertical momentum imparted is substantially greater than the vertical momentum that would be imparted by collisions between spheres.

A method for separating solid particles by particle size in still another aspect of the invention includes operating a gyratory sifter by imparting a substantially horizontal displacement to a sifter screen and to enhanced action cleaning elements. The displacement results in collisions between the cleaning elements, which are configured such that vertical momentum is imparted to the enhanced action cleaning elements substantially greater than that of collisions between spheres.

Other aspects and advantages of the invention will be apparent from the following description and the appended claims.

BRIEF DESCRIPTION OF THE DRAWINGS

A more complete understanding of the present disclosure and possible advantages thereof may be acquired by referring to the following description taken in conjunction with the accompanying figures, wherein.

Figure 1:
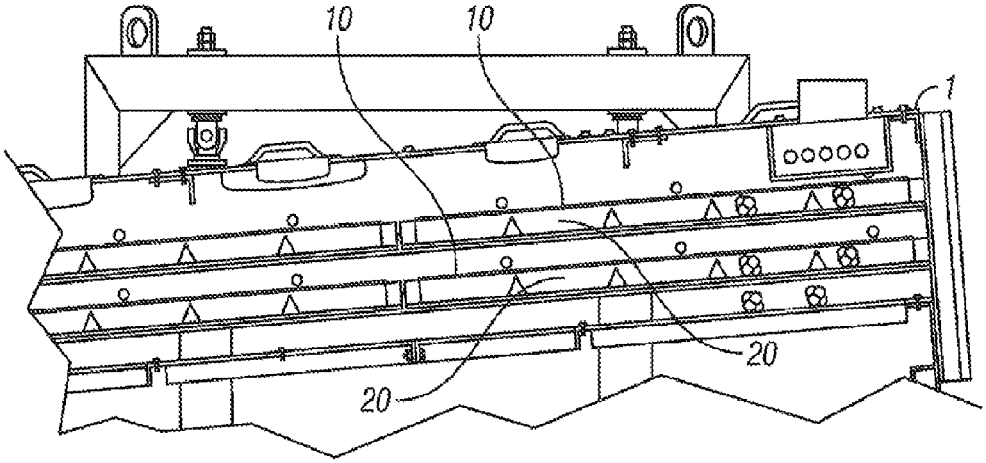
FIG. 1 shows a cross-sectional view of a gyratory sifter in accordance with one example of the present invention.
Figure 2:
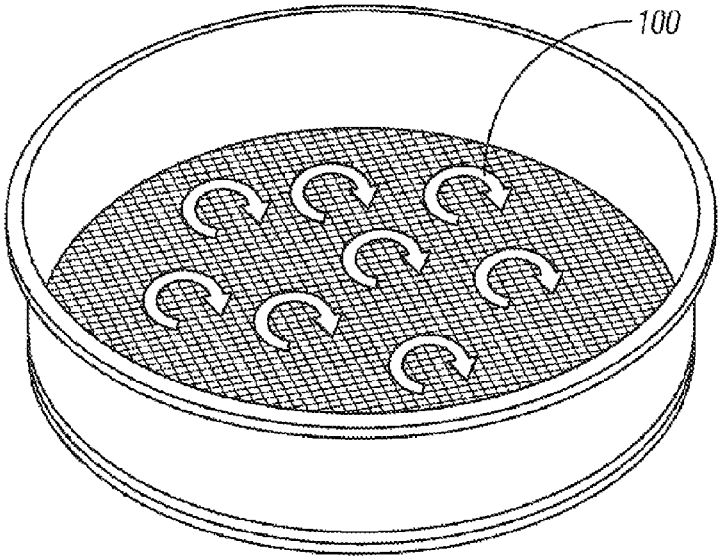
FIG. 2 shows a diagrammatic view of the sifting motion of a gyratory sifter in accordance with one example of the present invention.
Figure 3:
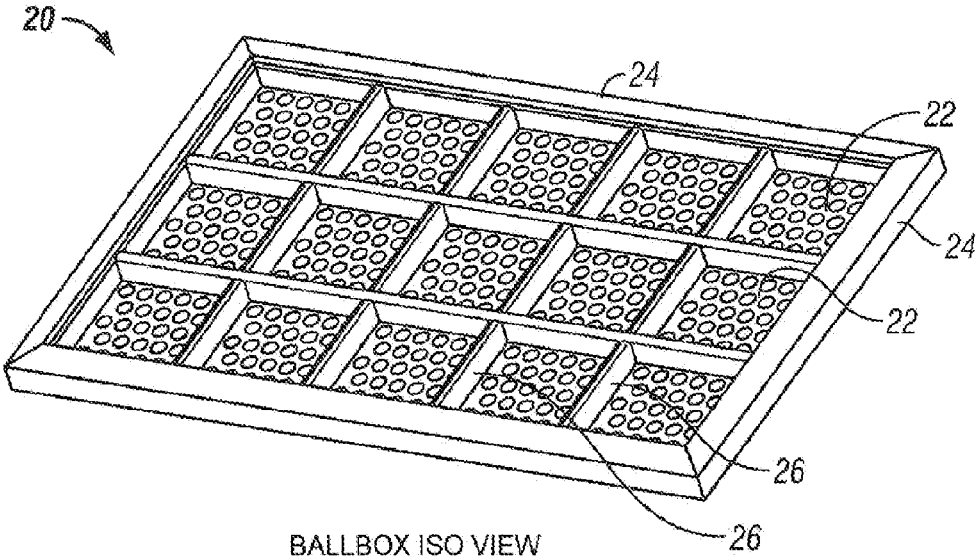
FIG. 3 shows an isometric view of a ballbox in accordance with one example of the present invention.
Figure 4:
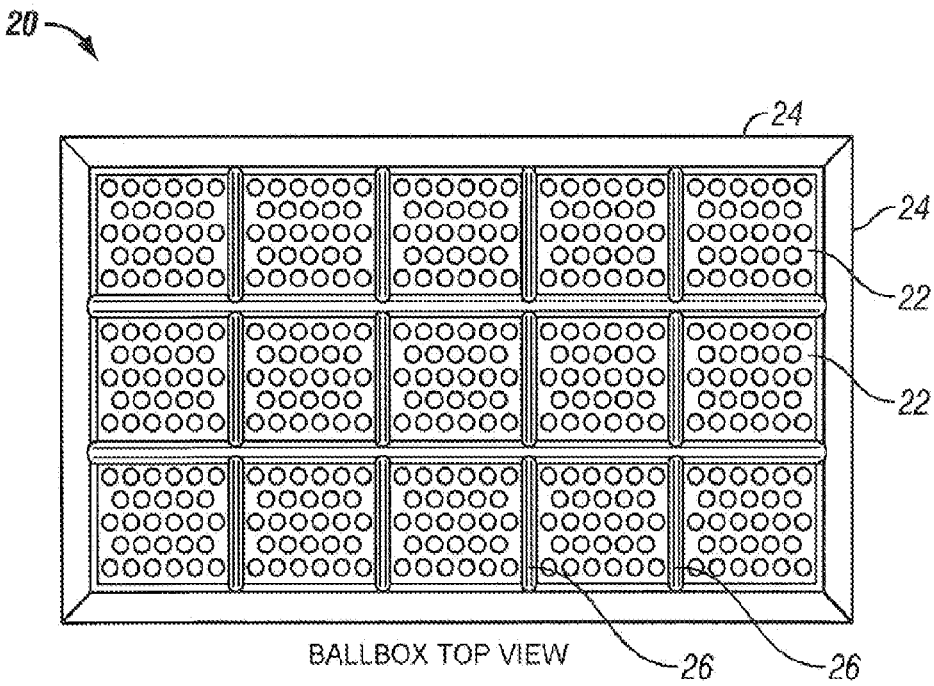
FIG. 4 shows a top view of a ballbox in accordance with one example of the present invention.

FIGS. **8*a*-8*h*** show enhanced action cleaning elements in accordance with examples of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the scope of the invention as defined by the appended claims.

DETAILED DESCRIPTION

The invention enables enhanced cleaning of screens (10) in a gyratory sifter, in part due to substantially greater vertical movement of enhanced action cleaning elements compared to spheres used in sifter deblinding known in the art. Because of the nature of a gyratory sifter, as described in the Background section hereinabove, most of the motive force is directed along a plane parallel to the surface of screens (10). Thus, little vertical force is available to propel spheres against the lower surface of screen (10) to dislodge agglomerated and near-hole-sized particles from the holes in screen (10). Random interaction between spheres and between spheres and the sides (24) and slats (26) does impart some vertical motion to spheres, however, such vertical motion maybe limited. It should be clearly understood that as used herein, the term "screen" is intended to include any device that enables passage of solids therethrough having particle size smaller than openings in the surface of the device. Other non-limiting examples devices that are within the intended meaning of "screen" include perforated plates.

Figure 5:
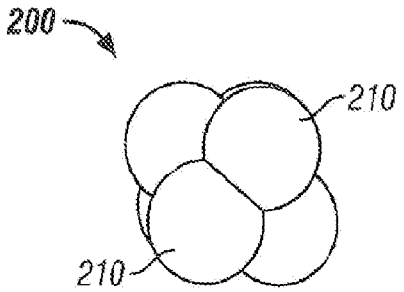
FIG. 5 shows a side view of an enhanced action cleaning element in accordance with one example of the present invention.
Figure 6:
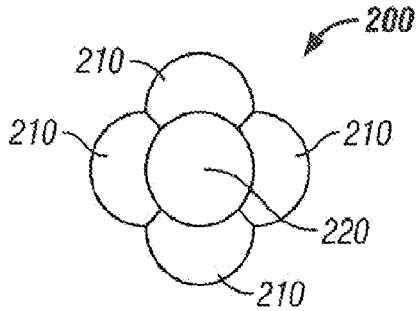
FIG. 6 shows a cross-sectional view of an enhanced action cleaning element in one example of the present invention.

Enhanced action cleaning elements may be used to increase the number of collisions between the lower surface of screen (10) and the cleaning elements, compared to that provided by spheres. Such enhanced action cleaning elements are configured to allow horizontal collisions between cleaning elements, as well as collisions between cleaning elements and sides (24) or slats (26) to impart substantially more vertical momentum to the enhanced action cleaning elements than the same interactions would provide when using spheres. Examples of such enhanced action cleaning elements include cubes, pyramids, and other polyhedrons (including tetrahedrons, pentahedrons, hexahedrons, heptahedrons, octahedrons, nonahedrons, decahedrons, undecahedronands) near-polyhedrons, and spheres with protuberances. FIGS. 8*a*-8*h* depict other examples of enhanced action cleaning elements. FIG. 5 shows a side view of one example of an enhanced action cleaning element (200) in accordance with the present invention. FIG. 6 shows a cross-sectional view of the example enhanced action cleaning element (200). As shown in FIG. 6, enhanced action cleaning element (200) can include six semi-spherical protuberances (210) around a center sphere (220). Enhanced action cleaning element (200) may be constructed of a number of suitable materials depending upon the service and elastomeric properties desired. Non-limiting examples include gum rubber, nylon, urethane, silicone and ethylene propylene diene M-class rubber ("EPDM").

The enhanced action cleaning elements (200) shown in FIG. 6 include six semi-spherical protuberances (210) that are of approximately the same diameter as that of center sphere (220) and are arranged at approximately equal intervals about the circumference of center sphere (220). The present example is non-limiting and other configurations of enhanced action cleaning elements (200) may include protuberances of different shapes and sizes, as well as different numbers thereof.

In accordance with the present invention, enhanced action cleaning elements (200) are contained within ballboxes (20) as shown in FIG. 1. Enhanced action elements (200) are retained between screens (10) and ball box screens (22). During operation of gyratory sifter (1), enhanced action cleaning elements (200) are configured to collide with the bottom surface of screens (10), dislodging agglomerated and near-hole-sized particles that have collected in holes of screens (10).

Because of the configuration of enhanced action cleaning elements (200), when enhanced action cleaning elements (200) collide with each other, certain collisions transfer momentum to have a component in a vertical direction, i.e., in a direction substantially normal to the screens (10) and ballbox screens (20). Thus, enhanced action cleaning elements (200) are more likely to contact screen (10) than traditional spheres, as described further in the Examples below. The foregoing action can increase the cleaning efficiency and therefore the overall efficiency of gyratory sifters equipped with enhanced action cleaning elements (200) than those using round cleaning spheres known in the art.

EXAMPLE 1

Figure 7:
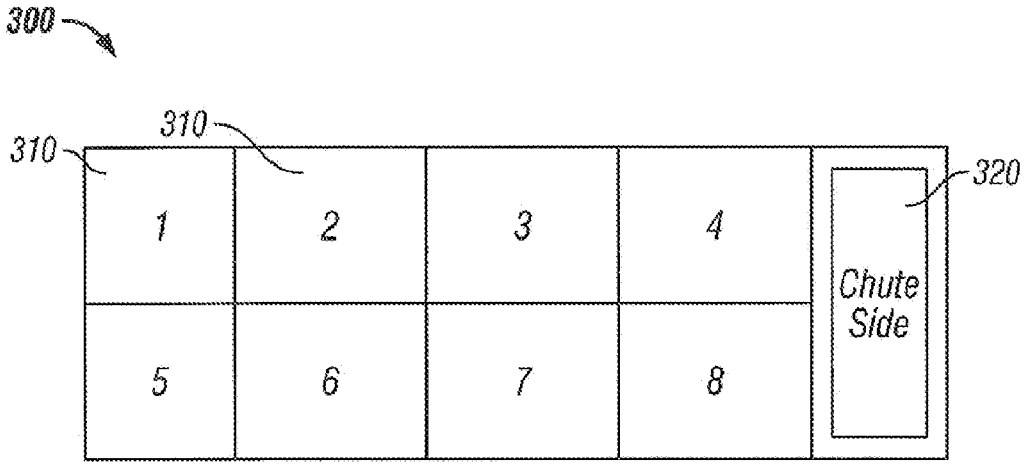
FIG. 7 shows a diagram of the marking of the screens of a gyratory sifter for Examples 1 and 2.
Figure 8A:
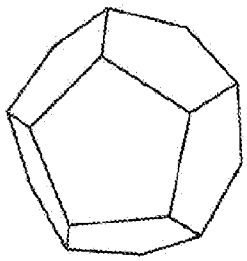
Figure 8B:
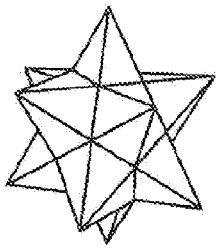
Figure 8C:
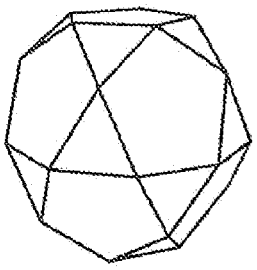
Figure 8D:
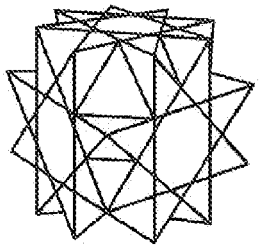
Figure 8E:
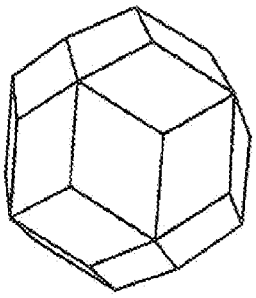
Figure 8F:
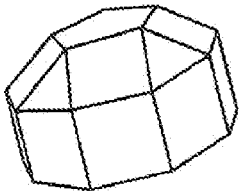
Figure 8G:
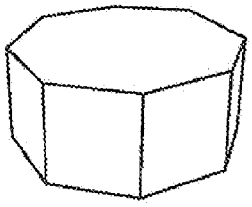
Figure 8H:
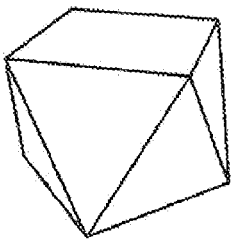

A gyratory sifter suitable for use in the present invention was prepared. The gyratory sifter was run at 310 rpm. An accelerometer was mounted on the screen to count the cleaning element strikes and their impact acceleration against the lower surface of the screen. The impacts were measured in two groups—those whose impacts were above 0.25 G and those where the impact was above 0.5 G. The ballbox was marked into 8 different sections, as shown in FIG. 7. FIG. 7 depicts marked screen (300) with individually marked areas 1-8 (310). Chute side (320) of marked screen (300) is further depicted in FIG. 7.

Three enhanced action cleaning elements, of the type depicted in FIGS. 5 and 6 were placed within each of the 8 different sections. The gyratory sifter was placed into service and allowed to reach operational speed. This process was repeated five times. The strikes against the screens in each section were then counted, as shown in TABLE 1.

TABLE 1

ENHANCED ACTION CLEANING ELEMENTS

| | Enhanced Action | | | | | |
|---|---|---|---|---|---|---|
| | Section | Average | Max. | Min. | Range. | Mode |
| 0.25G | 1 | 63.76 | 71 | 56 | 15 | 64 |
| | 2 | 58.8 | 68 | 49 | 19 | 60 |
| | 3 | 64.2 | 76 | 50 | 26 | 66 |
| | 4 | 61.6 | 71 | 47 | 24 | 67 |
| | 8 | 62.1 | 70 | 55 | 15 | 62 |
| | 7 | 57.0 | 65 | 27 | 38 | 60 |
| | 6 | 63.0 | 73 | 54 | 19 | 67 |
| | 5 | 56.9 | 63 | 53 | 10 | 55 |
| 0.5G | 1 | 35.04 | 44 | 23 | 21 | 38 |
| | 2 | 17.24 | 31 | 7 | 24 | 18 |
| | 3 | 23.88 | 36 | 10 | 26 | 18 |
| | 4 | 21.44 | 34 | 9 | 25 | 24 |
| | 8 | 16.04 | 22 | 8 | 14 | 18 |
| | 7 | 21.52 | 32 | 12 | 20 | 12 |
| | 6 | 15.08 | 25 | 2 | 23 | 15 |
| | 5 | 29.92 | 42 | 20 | 22 | 28 |

A test with the same sifter configuration described above for Example 1 was then run, except that spheres were used rather than enhanced action cleaning elements. Such process was repeated five times. The strikes against the screens in each section were then counted, as shown in TABLE 2.

TABLE 2

| SPHERES | | | | | | |
|---|---|---|---|---|---|---|
| | Spheres | | | | | |
| | Section | Average | Max. | Min. | Range. | Mode |
| 0.25G | 1 | 63.80 | 72 | 56 | 16 | 65 |
| | 2 | 54.84 | 67 | 41 | 26 | 51 |
| | 3 | 58.44 | 73 | 44 | 29 | 65 |
| | 4 | 49.96 | 61 | 41 | 20 | 42 |
| | 8 | 61.92 | 71 | 54 | 17 | 64 |
| | 7 | 53.52 | 60 | 41 | 19 | 56 |
| | 6 | 57.16 | 75 | 41 | 34 | 57 |
| | 5 | 47.68 | 59 | 28 | 31 | 51 |
| 0.5G | 1 | 43.44 | 52 | 33 | 19 | 44 |
| | 2 | 17.84 | 31 | 11 | 20 | 11 |
| | 3 | 19.2 | 42 | 2 | 40 | 9 |
| | 4 | 11.16 | 20 | 3 | 17 | 4 |
| | 8 | 8.88 | 17 | 1 | 16 | 6 |
| | 7 | 18.28 | 39 | 2 | 37 | 12 |
| | 6 | 12.32 | 22 | 2 | 20 | 12 |
| | 5 | 32.24 | 42 | 18 | 24 | 37 |

Differences between the enhanced action cleaning elements in Example 1 and the spheres in Example 2 are compared in TABLE 3.

TABLE 3

| COMPARISON | | |
|---|---|---|
| | Section | Round vs Enhance % Difference |
| 0.25 G | 1 | 0 |
| | 2 | −7 |
| | 3 | −10 |
| | 4 | −23 |
| | 8 | 0 |
| | 7 | −7 |
| | 6 | −10 |
| | 5 | −19 |
| | Section | % Difference |
| 0.5 G | 1 | 19 |
| | 2 | 3 |
| | 3 | −24 |
| | 4 | −92 |
| | 8 | −81 |
| | 7 | −18 |
| | 6 | −22 |
| | 5 | 7 |

For strikes with lower intensity, i.e., 0.25 G, there was an increased number of strikes when using the enhanced action cleaning elements as compared to when using spheres. Such increase was particularly evident in sections 4 and 5 and least evident in sections 1 and 8.

The examples disclosed herein have generally been described in the context of a gyratory sifter installation. Those skilled in the art with the benefit of the present disclosure will appreciate that examples of enhanced cleaning elements as described herein would be suitable for other types of sifters. Additionally, it is explicitly recognized that any of the features and elements of the examples disclosed herein may be combined with or used in conjunction with any of the examples disclosed herein.

While the invention has been described with respect to a limited number of examples, those skilled in the art, having benefit of this disclosure, will appreciate that other implementations can be devised which do not depart from the scope of the invention as disclosed herein. Accordingly, the scope of the invention should be limited only by the attached claims.

What is claimed is:

1. A system comprising:

a gyratory sifter comprising a screen and a ballbox disposed below the screen;

a plurality of cleaning elements disposed between the screen and the ballbox, the cleaning elements comprising a central sphere having an outer surface; and a plurality of spherical protuberances spaced equally around the outer surface of the central sphere wherein the cleaning elements impart vertical momentum to each other as a result of collisions therebetween caused by operating the gyratory sifter wherein the vertical momentum causes the cleaning elements to contact the screen.

2. The system according to claim 1 further comprising:

six spherical protuberances equally spaced about the outer surface of the central sphere forming three pairs of diametrically opposed spherical protuberances on the surface of the central sphere.

3. The system according to claim 1 wherein the spherical protuberances have substantially equal radii.

4. The system according to claim 3, wherein the radii of the spherical protuberances are approximately equal to the radius of the central sphere.

5. The system according to claim 1, wherein the non-spherical cleaning elements are made from at least one of gum rubber, nylon, urethane, silicone and ethylene propylene diene M-class rubber.

6. A system comprising:

a gyratory sifter comprising a screen and a ballbox; and a plurality of polyhedral cleaning elements retained between the screen and the ballbox wherein the plurality of polyhedral cleaning elements collide with each other and the ballbox and impart vertical momentum to each other as a result of those collisions wherein the polyhedral cleaning elements have shapes selected from a group consisting of docedahedrons, stellated docedahedrons, icosidodecahedrons, rhombic triaconlahedrons and square antiprisms.

7. A method comprising:

placing a plurality of enhanced action cleaning elements between a screen and a ballbox of a gyratory sifter wherein the enhanced action cleaning elements have a nonuniform surface wherein the non-spherical cleaning elements are made from at least one of gum rubber, nylon, urethane, silicone and ethylene propylene diene M-class rubber and further wherein the non-spherical cleaning elements comprise an inner sphere and a plurality of protuberances spaced about a circumference of the inner sphere;

applying circular motion to the screen and the ballbox of the gyratory sifter wherein the circular motion is directed along a plane parallel to the screen of the gyratory sifter;

colliding the enhanced action cleaning elements wherein the collisions impart momentum perpendicular to the screen on the enhanced action cleaning elements;

striking the screen with the enhanced action cleaning elements; and separating solids by particle size.

8. The method according to claim 7, wherein the protuberances are semi-spherical and wherein the protuberances are substantially equally spaced about a circumference of the inner sphere and wherein the protuberances have substantially equal radii.

9. The method according to claim 8 wherein the radii of the semi-spherical protuberances are approximately equal to the inner radius of the inner sphere.

* * * * *